United States Patent [19]

Yokoyama et al.

[11] Patent Number: 4,623,615

[45] Date of Patent: Nov. 18, 1986

[54] SILVER HALIDE PHOTOGRAPHIC LIGHT-SENSITIVE MATERIALS

[75] Inventors: Shigeki Yokoyama, Kanagawa; Nobuhisa Sekiguchi, Shizuoka, both of Japan

[73] Assignee: Fuji Photo Film Co., Ltd., Kanagawa, Japan

[21] Appl. No.: 658,740

[22] Filed: Oct. 9, 1984

[30] Foreign Application Priority Data

Oct. 7, 1983 [JP] Japan ..... 58-188228

[51] Int. Cl.[4] ..... G03C 1/82

[52] U.S. Cl. ..... 430/527; 430/530; 430/637

[58] Field of Search ..... 430/637, 527, 530

[56] References Cited

U.S. PATENT DOCUMENTS

| | | | |
|---|---|---|---|
| 3,725,079 | 4/1973 | Mackey | 430/637 |
| 3,868,254 | 2/1975 | Wemmers | 430/637 |
| 4,050,940 | 9/1977 | Habu et al. | 430/527 |
| 4,092,171 | 5/1978 | Bigelow | 430/605 |
| 4,272,616 | 6/1981 | Kishimoto | 430/637 |

*Primary Examiner*—Jack P. Brammer

*Attorney, Agent, or Firm*—Sughrue, Mion, Zinn Macpeak & Seas

[57] ABSTRACT

A silver halide photographic light-sensitive material is described having at least one light-sensitive silver halide emulsion layer on a base, wherein the improvement comprises that said light-sensitive silver halide emulsion layer or another hydrophilic colloid layer on said base contains a polyoxyethylene type surfactant and a complex salt of divalent or tetravalent palladium.

13 Claims, No Drawings

SILVER HALIDE PHOTOGRAPHIC LIGHT-SENSITIVE MATERIALS

FIELD OF THE INVENTION

The present invention relates to silver halide photographic light-sensitive materials (hereinafter, referred to as "photographic light-sensitive materials"), and particularly to photographic light-sensitive materials wherein an antistatic property and an antifogging property are improved at the same time.

BACKGROUND OF THE INVENTION

Photographic light-sensitive materials are generally composed of a base having an electrical insulating property and photographic layers, and electrostatic charges are easily accumulated due to rubbing friction between surfaces of the same kind or different kinds of materials or separation thereof in the steps of producing the photographic light-sensitive materials or during use thereof. These accumulated electrostatic charges cause many problems. The most serious problem is that electrostatic charges accumulated before development processing cause dotted spots or resinous or feathered markings when carrying out development processing of the photographic film, because the light-sensitive emulsion layer is sensitized by discharging. This is the so-called "static mark", by which commercial value of a photographic film is greatly damaged or is sometimes completely lost. For example, it is easily recognized that when such static marks appear on medical or industrial X-ray films, erroneous judgments may be induced. This phenomenon is also very troublesome because it is only confirmed upon development. Further, these accumulated electrostatic charges induce secondary problems, for example, dusts adhere to the surface of films or uniform application can not be carried out.

As noted above, such electrostatic charges are easily accumulated during production of the photographic light-sensitive materials and use thereof. For example, during production steps, they can be generated by rubbing friction between the photographic film and a roll, or by separation of the emulsion face from the base in a step of winding or rewinding the photographic films. Further, they can be generated by contact with or separation from machine parts or fluorescent sensitizing paper in automatic photographing machines for X-ray films. In addition, they can be generated by contact with packing materials.

Such static marks on the photographic light-sensitive materials induced by accumulation of electrostatic charges becomes remarkable with increases in sensitivity and increases in processing rates. Particularly, in recent years, generation of static mark has tended to be easily caused because of increasing use of photographic light-sensitive materials having high sensitivity, and because such materials are frequently subjected to severe handling, such as high speed application of photographic layers to a base, high speed photography, high speed automatic processing, etc.

In order to overcome these problems due to static electricity, it is preferred to add antistatic agents to photographic light-sensitive materials. However, antistatic agents used generally in other fields of technology can not always be used for photographic light-sensitive materials, and they are subjected to various restrictions specific to photographic light-sensitive materials. Namely, antistatic agents capable of utilization for photographic light-sensitive materials require not only excellent antistatic performance, but also other properties, for example, (1) they should not have any adverse influence upon photographic characteristics of the photographic light-sensitive material, such as sensitivity, fog, granularity, sharpness, etc., (2) they should not have an adverse influence upon the physical properties of the photographic light-sensitive material (e.g., the film is not easily damaged by friction or scratching), (3) they should not have an adverse influence upon antiadhesive characteristics (i.e., the surface of a photographic light-sensitive material should not easily adhere to the surface of another photographic light-sensitive material or other surfaces), (4) they should not promote fatigue of processing solutions for photographic light-sensitive materials, and (5) they do not promote deterioration of adhesive strength between layers in the photographic light-sensitive material. Accordingly, application of the antistatic agents to photographic light-sensitive materials is subject to many restrictions.

One method for overcoming problems due to static electricity is to increase electric conductivity of a surface of the light-sensitive material, so that electrostatic charges disappear in a short time, before the electric charge can accumulate and discharge with adverse effects.

Therefore, it has been attempted hitherto to increase electrical conductivity of the base or various surface layers in photographic light-sensitive materials by utilizing various hygroscopic substances or water soluble inorganic salts, certain kinds of surfactants and polymers, etc. For example, it has been known to use polymers as described in U.S. Pat. Nos. 2,882,157, 2,972,535, 3,062,785, 3,262,807, 3,514,291, 3,615,531, 3,753,716 and 3,938,999, etc., surfactants as described in U.S. Pat. Nos. 2,982,651, 3,428,456, 3,457,076, 3,454,625, 3,552,972 and 3,655,387, etc., and metal oxides and colloidal silica as described in U.S. Pat. Nos. 3,062,700, 3,245,833 and 3,525,621, etc.

However, it is very difficult to generalize the use these substances for photographic light-sensitive materials, because (1) these substances show specificity depending upon the kind of film base or photographic composition, and they are not useful for preventing electrification in certain film bases and photographic emulsions or other photographic elements, though they may provide good results in some other film bases and photographic emulsions or photographic elements, or (2) they have an adverse influence upon photographic characteristics of photographic emulsions, such as sensitivity, fog, granularity, sharpness, etc., even though they might have an excellent antistatic characteristics, or (3) the antistatic characteristic deteriorates with the passage of time, even though the photographic light-sensitive material might have an excellent antistatic characteristic just after production.

British Pat. No. 861,134, German Pat. No. 1,422,809, and U.S. Pat. No. 3,850,641 have disclosed that an excellent effect in preventing electrification is obtained by incorporating polyoxyethylene type surfactants in photographic light-sensitive materials.

However, such photographic light-sensitive materials containing polyoxyethylene type surfactants have had a serious fault. Namely, when the photographic light-sensitive materials containing the polyoxyethylene type surfactants are stored prior to use under high temperature conditions (e.g., 40° C. or higher), blackened silver is deposited in nonexposed areas during development as well as in exposed areas; i.e., such surfactants have a tendency to cause fog. This can be a fatal fault in photographic light-sensitive materials, because it can significantly deteriorate the quality of the photographic images.

In order to prevent the occurrence of fog, it has been a general practice in the silver salt photographic field to add organic heterocyclic compounds, as described, e.g., in *Stabilization of Photographic Silver Halide Emulsion* Dr. E. J. Birr, Focal Press, London-New York, pages 52–99, 1974; *Shashinkogaku no Kiso,* Chapter entitled Silver salt photography, edited by Nippon Shashin Gakkai, Corona Co., pages 189–204, 1979; and Japanese Patent Application (OPI) No. 164,734/82 (the term "OPI" as used herein refers to a "published unexamined Japanese patent application") to photographic light-sensitive materials. However, if organic heterocyclic compounds are added to photographic light-sensitive materials in which the polyoxyethylene type surfactants are used for the purpose of improving antistatic performance, fog can not be effectively prevented. Particularly, if it is intended to prevent occurrence of fog by increasing the amount of the organic heterocyclic compounds, the effect can be recognized to some extent, but photographic sensitivity, which is the single most important property of the photographic light-sensitive material, deteriorates significantly. Consequently, the amount of the organic heterocyclic compounds that can be used is restricted, and fog can not be substantially prevented.

Thus, as described above, it has been difficult to effectively prevent the occurrence of fog in photographic light-sensitive materials in which the antistatic property is provided by adding polyoxyethylene type surfactants.

SUMMARY OF THE INVENTION

Thus, a first object of the present invention is to provide a photographic light-sensitive material having an excellent antistatic property which provide excellent photographic images without harmful fog even if stored before use under a high temperature conditions.

A second object of the present invention is to provide a photographic light-sensitive material having an excellent antistatic property which have suitable photographic sensitivity.

As a result of extensive studies, it has now been found that a photographic light-sensitive material in which the antistatic property and the antifogging property are improved at the same time can be obtained by the combined use of a polyoxyethylene type surfactant and a palladium complex salt.

More particularly, the objects of the present invention can be attained by incorporating a polyoxyethylene type surfactant and a complex salt of divalent or tetravalent palladium in a light-sensitive silver halide emulsion layer or another hydrophilic colloid layer of a photographic light-sensitive material.

DETAILED DESCRIPTION OF THE INVENTION

Palladium complex salts have been known in the photographic field as compounds having a function of preventing occurrence of fog, in addition to the above described organic heterocyclic compounds. Examples thereof have been disclosed in U.S. Pat. Nos. 2,448,060, 2,472,627, 2,472,631, 2,540,086, 2,552,229, 2,566,263, 2,598,079, 4,092,171, etc.

However, it is entirely unexpected that, in order to prevent the occurrence of fog in photograhic light-sensitive materials in which polyoxyethylene type surfactants are used for preventing electrification, palladium complex salts show a singularly remarkable effect of preventing the occurrence of fog without deterioration of the sensitivity and antistatic property, while on the other hand the organic heterocyclic compounds which have been most generally used in the photographic field scarcely show any effect of preventing the occurrence of fog.

Moreover, in the present invention, when the palladium complex salts are used, the processing dependence of the photographic light-sensitive materials can be improved. The expression "processing dependence" refers to variations of the image density (Dmax, etc.) caused by a change in the processing conditions of the exposed photographic light-sensitive material, for example, a change of development temperature. The improvement of the processing dependence, i.e., that variations in the processing conditions do not adversely affect the final image, is a very useful matter, because the quality of the resulting photographic light-sensitive materials is thereby stabilized.

As polyoxyethylene type surfactants in the present invention, those having at least two oxyethylene groups, and preferably 5 to 50 oxyethylene groups, can be used.

As the polyoxyethylene type surfactants, surfactants represented by the following formulae (I-1), (I-2), and (I-3) are particularly suitable for use.

$$R_1-A-(CH_2CH_2O)_{n1}-H \qquad \text{Formula (I-1)}$$

Formula (I-2)

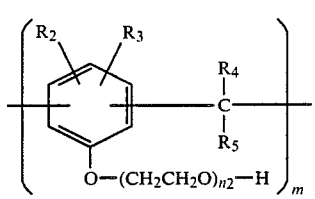

Formula (I-3)

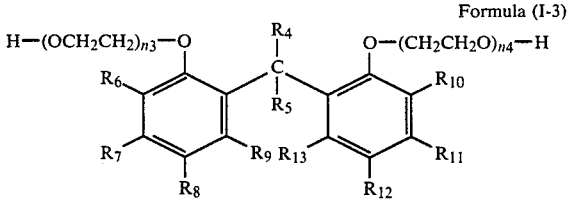

In the formulae, $R_1$ represents a substituted or unsubstituted alkyl group having from 1 to 30 carbon atoms, an alkenyl group or an aryl group, and A represents —O—, —S—, —COO—, $$-\underset{|}{N}-R_{14},\ -CO-\underset{|}{N}-R_{14} \text{ or } -SO_2\underset{|}{N}-R_{14}$$

(wherein $R_{14}$ represents a hydrogen atom or a substituted or unsubstituted alkyl group).

$R_2$, $R_3$, $R_7$, $R_9$, $R_{11}$, and $R_{13}$ each represents a hydrogen atom, a substituted or unsubstituted alkyl group, an aryl group, an alkoxy group, a halogen atom, an acyl group, an amide group, a sulfonamide group, a carbamoyl group, or a sulfamoyl group. Further, $R_6$, $R_8$, $R_{10}$, and $R_{12}$ each represents a unsubstituted alkyl group, an aryl group, an alkoxy group, a halogen atom, an acyl group, an amide group, a sulfonamide group, a carbamoyl group, or a sulfamoyl group.

$R_4$ and $R_5$ each represents a hydrogen atom, a substituted or unsubstituted alkyl group, an aryl group, or a heteroaromatic ring.

$R_4$ and $R_5$, $R_6$ and $R_7$, $R_8$ and $R_9$, $R_{10}$ and $R_{11}$, and $R_{12}$ and $R_{13}$ may form a substituted or unsubstituted ring by linking together. $n_1$, $n_2$, $n_3$, and $n_4$ are each an average degree of polymerization of ethylene oxide, which is a number of from 2 to 50, preferably from 5 to 50.

m is an average degree of polymerization, which is a number of from 2 to 50, preferably from 5 to 50.

In formulae (I-1), (I-2), and (I-3), $R_1$ is preferably an alkyl group having from 4 to 24 carbon atoms, an alkenyl group or an alkylaryl group, and particularly it is preferred to represent a hexyl group, a dodecyl group, an isostearyl group, an oleyl group, a t-butylphenyl group, a 2,4-di-t-butylphenyl group, a 2,4-di-t-pentylphenyl group, a p-dodecylphenyl group, a m-pentadecaphenyl group, a t-octylphenyl group, a 2,4-dinonylphenyl group, an actylnaphthyl group, etc.

$R_2$, $R_3$, $R_6$, $R_7$, $R_8$, $R_9$, $R_{10}$, $R_{11}$, $R_{12}$, and $R_{13}$ preferably each represents a substituted or unsubstituted alkyl group having from 1 to 20 carbon atoms, such as methyl, ethyl, i-propyl, t-butyl, t-amyl, t-hexyl, t-octyl, nonyl, decyl, dodecyl, trichloromethyl, tribromomethyl, 1-phenylethyl, or 2-phenyl-2-propyl, etc., a substituted or unsubstituted aryl group such as a phenyl group or p-chlorophenyl group, etc., a substituted or unsubstituted alkoxy group represented by $-OR_{15}$ (wherein $R_{15}$ represents a substituted or unsubstituted alkyl group having from 1 to 20 carbon atoms, or an aryl group), a halogen atom such as a chlorine atom or bromine atom, etc., an acyl group represented by $-COR_{15}$ (wherein $R_{15}$ represents a substituted or unsubstituted alkyl group having from 1 to 20 carbon atoms, or an aryl group), an amide group represented by $-NR_{16}COR_{15}$ (wherein $R_{16}$ represents a hydrogen atom or an alkyl group having from 1 to 20 carbon atoms, and $R_{15}$ represents a substituted or unsubstituted alkyl group having from 1 to 20 carbon atoms, or an aryl group), a sulfonamide group represented by $-NR_{16}SO_2R_{15}$ (wherein $R_{16}$ represents a hydrogen atom or an alkyl group having from 1 to 20 carbon atoms, and $R_{15}$ represents a substituted or unsubstituted alkyl group having from 1 to 20 carbon atoms, or an aryl group), a carbamoyl group represented by

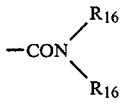

(wherein $R_{16}$ represents a hydrogen atom or an alkyl group having from 1 to 20 carbon atoms), or a sulfamoyl group represented by

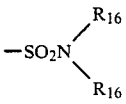

(wherein $R_{16}$ represents a hydrogen atom or an alkyl group having from 1 to 20 carbon atoms), and $R_2$, $R_3$, $R_7$, $R_9$, $R_{11}$, and $R_{13}$ may each represents a hydrogen atom. Of these, $R_6$, $R_8$, $R_{10}$, and $R_{12}$ preferably each represents an alkyl group or a halogen atom, and, particularly preferably, a bulky tertiary alkyl group such as a t-butyl group, t-amyl group, t-octyl group, etc. It is particularly preferred that $R_7$, $R_9$, $R_{11}$, and $R_{13}$ each represents a hydrogen atom. That is, compounds represented by formula (I-3) synthesized from 2,4-disubstituted phenols are particularly preferred.

$R_4$ and $R_5$ preferably each represents a hydrogen atom, a substituted or unsubstituted alkyl group such as a methyl group, an ethyl group, a n-propyl group, an i-propyl group, a n-heptyl group, a 1-ethylamyl group, a n-undecyl group, a trichloromethyl group or a tribromomethyl group, etc., or a substituted or unsubstituted aryl group such as an $\alpha$-furyl group, a phenyl group, a naphthyl group, a p-chlorophenyl group, a p-methoxyphenyl group, an m-nitrophenyl group, etc.

$R_4$ and $R_5$, $R_6$ and $R_7$, $R_8$ and $R_9$, $R_{10}$ and $R_{11}$, and $R_{12}$ and $R_{13}$ may form a substituted or unsubstituted ring such as a cyclohexyl ring by linking to each other.

It is particularly preferred that $R_4$ and $R_5$ each represents a hydrogen atom, an alkyl group having from 1 to 8 carbon atoms, a phenyl group, or a furyl group. It is particularly preferred that $n_1$, $n_2$, $n_3$, and $n_4$ are each a number of 5 to 30. $n_3$ and $n_4$ may be identical or different each other.

Of the formulae, compounds of formulae (I-2) and (I-3) are preferably used, and compounds of formula (I-3) are particularly preferably used.

In the following, examples of polyoxyethylene type surfactants of the present invention are described.

Examples of compound:

$C_{11}H_{23}COO-(CH_2CH_2O)_8-H$ I-1

$C_{15}H_{31}COO-(CH_2CH_2O)_{15}-H$ I-2

$C_{17}H_{33}COO(CH_2CH_2O)_{15}H$ I-3

$C_8H_{17}O(CH_2CH_2O)_7H$ I-4

$C_{12}H_{25}O(CH_2CH_2O)_{10}H$ I-5

$C_{16}H_{33}O(CH_2CH_2O)_{12}H$ I-6

I-7

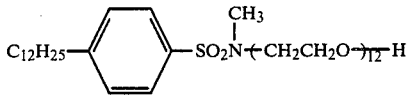

$C_{22}H_{45}O(CH_2CH_2O)_{25}H$ I-8

I-9

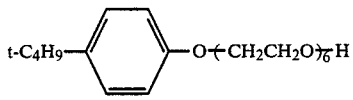

I-10

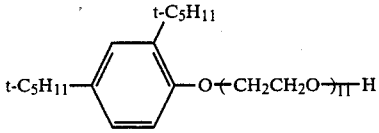

I-11

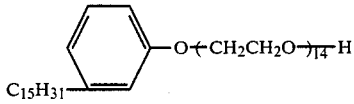

-continued
I-12
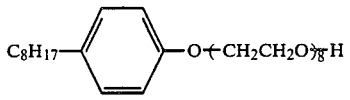
I-13
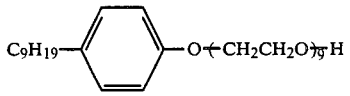
I-14
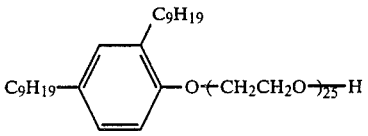
I-15
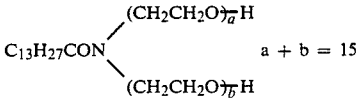
a + b = 15
I-16
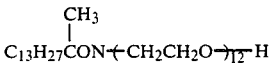
I-17
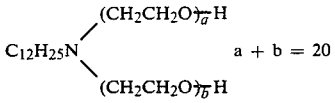
a + b = 20
I-18
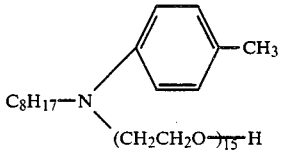
I-19
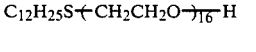
I-20
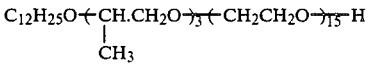
I-21
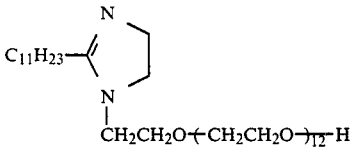
I-22
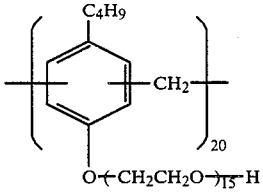
I-23
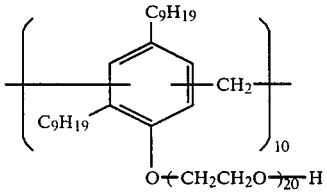
-continued
I-24
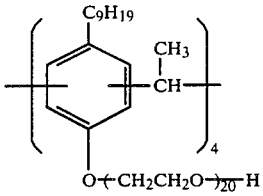
I-25
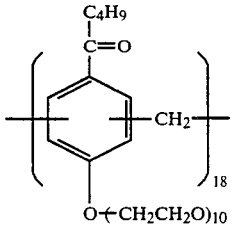
I-26
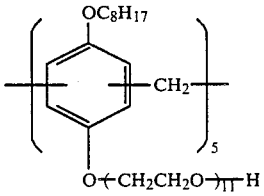
I-27
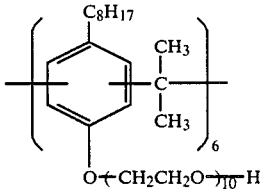
I-28
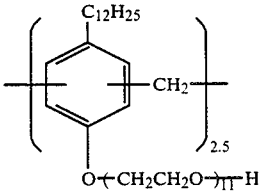
I-29
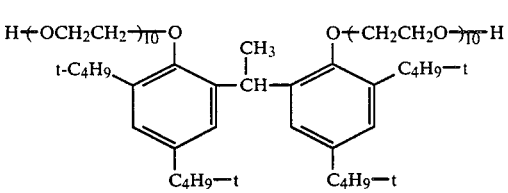
I-30
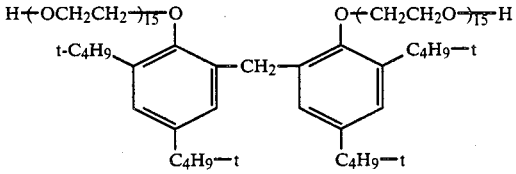
I-31
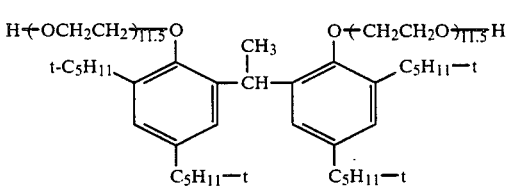

-continued
I-32
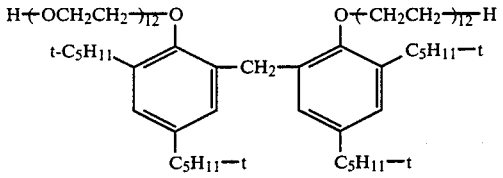
I-33
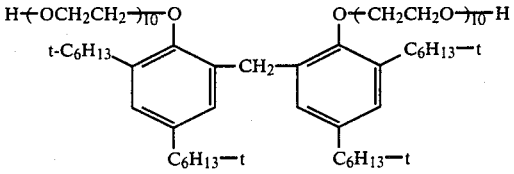
I-34
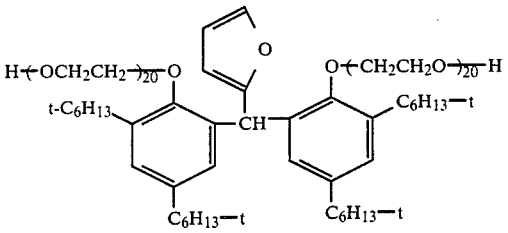
I-35
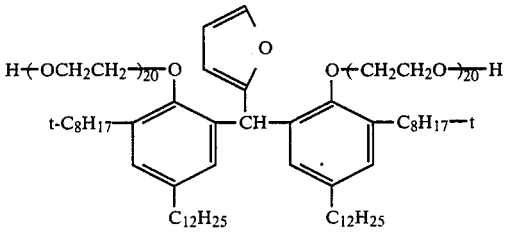
I-36
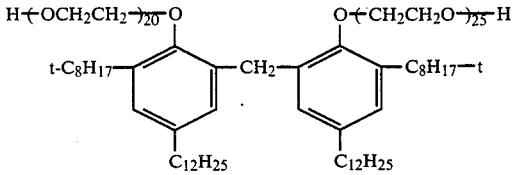
I-37
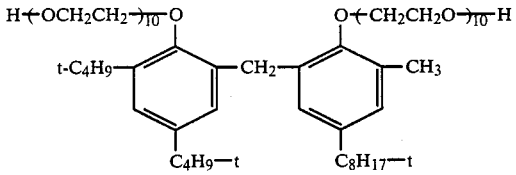
I-38
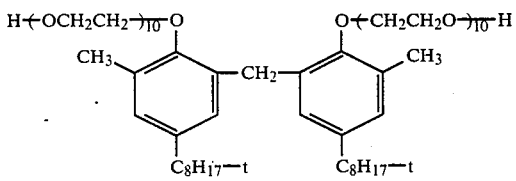
-continued
I-39
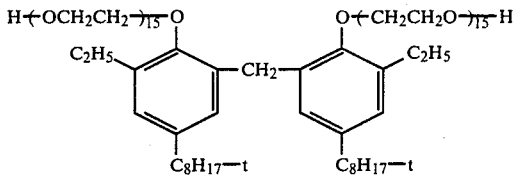
I-40
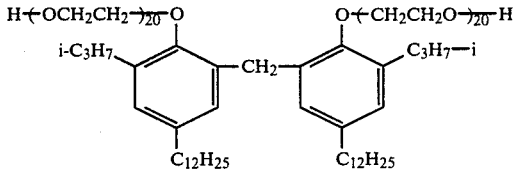
I-41
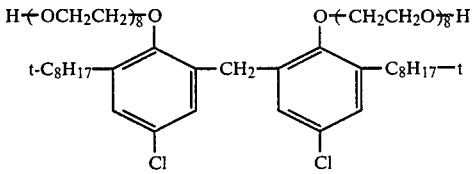
I-42
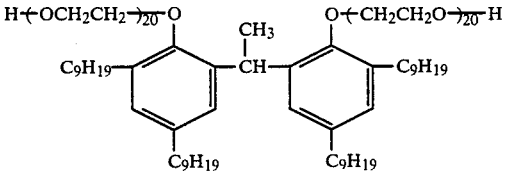
I-43
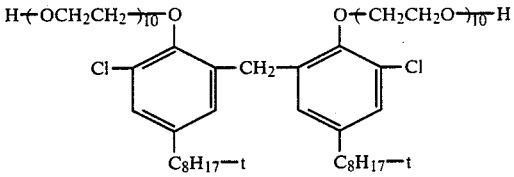
I-44
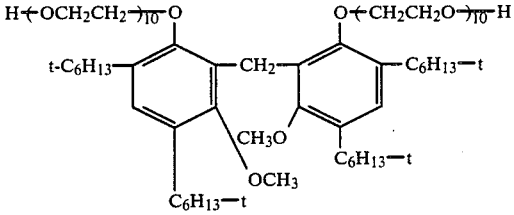
I-45
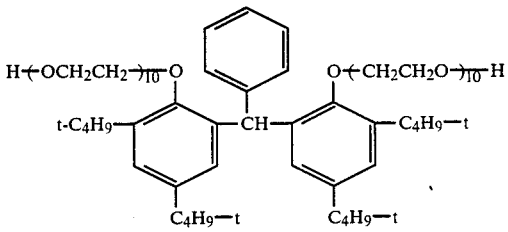

-continued
I-46
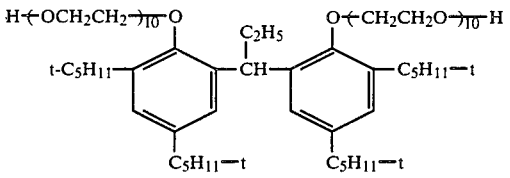
I-47
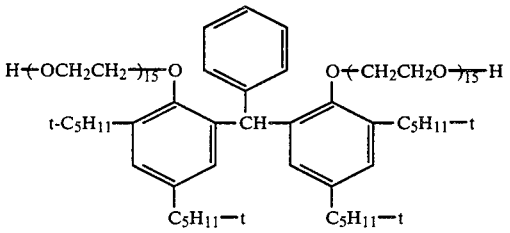
I-48
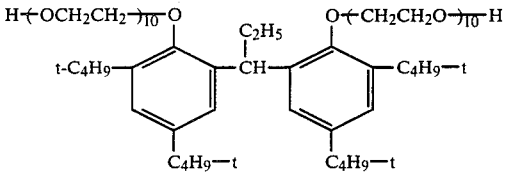
I-49
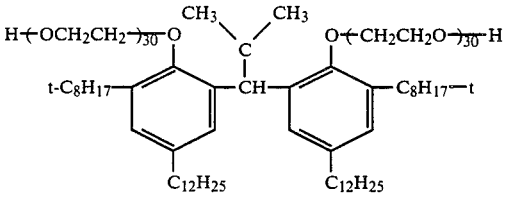
I-50
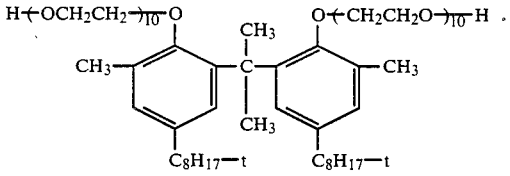
I-51
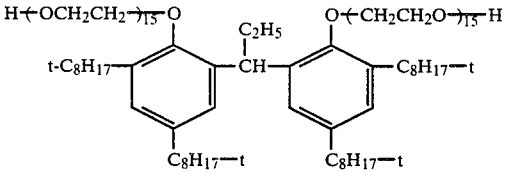
I-52
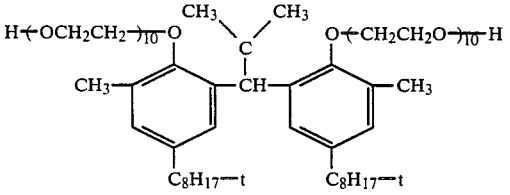
I-53
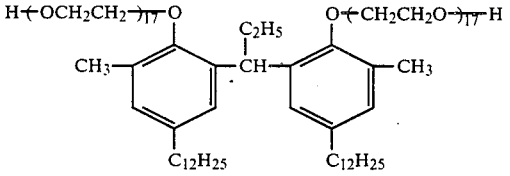
-continued
I-54
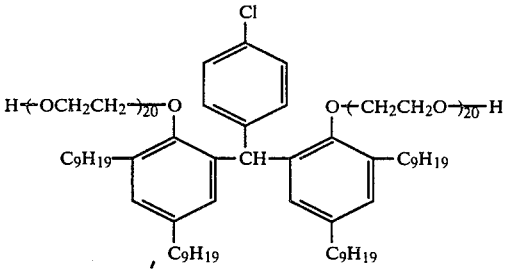
I-55
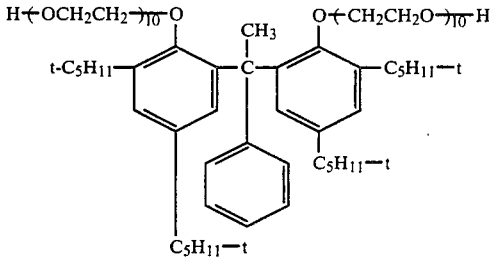
I-56
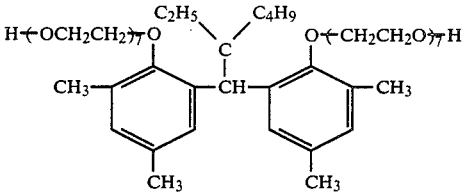
I-57
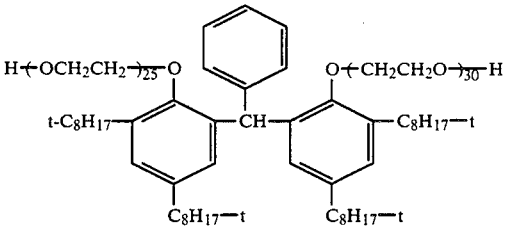
I-58
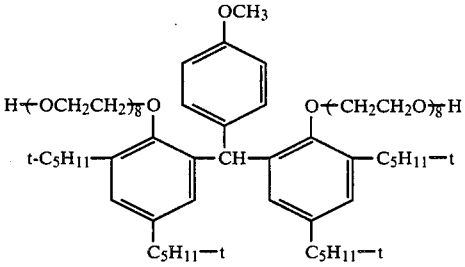
I-59
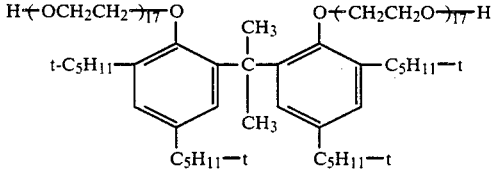

-continued

I-60

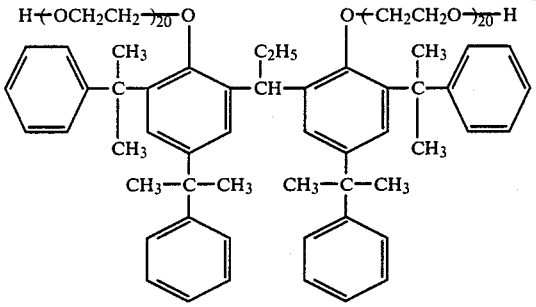

I-61

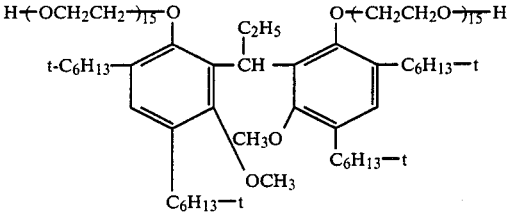

I-62

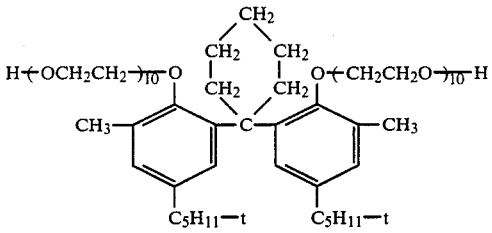

I-63

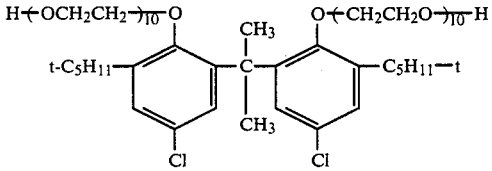

I-64

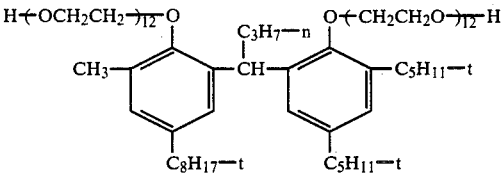

I-65

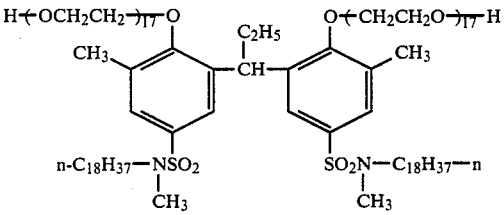

I-66

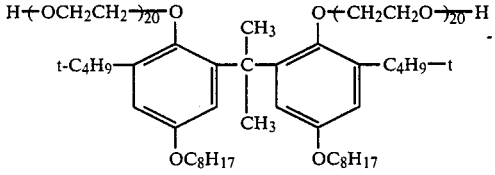

-continued

I-67

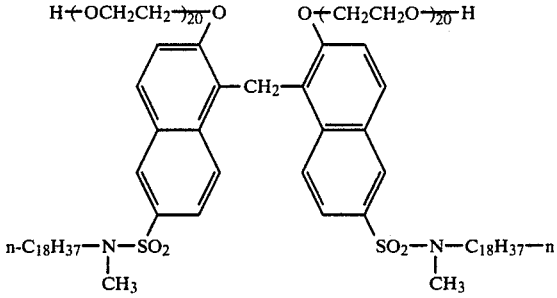

I-68

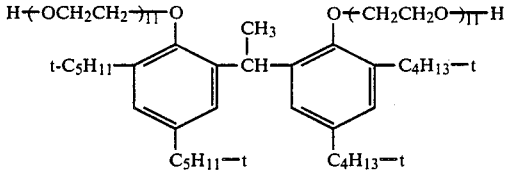

I-69

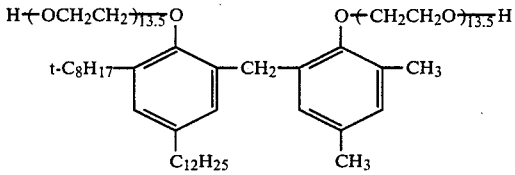

I-70

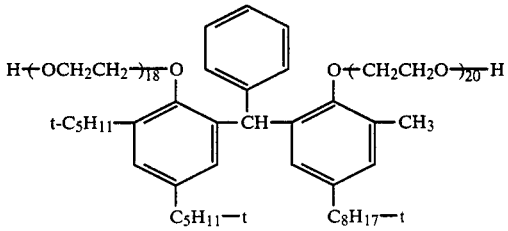

I-71

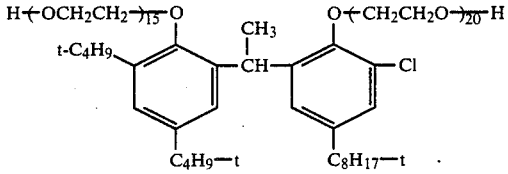

Examples of the polyoxyethylene type surfactants used in the present invention include those described, for example, in U.S. Pat. Nos. 2,982,651, 3,428,456, 3,457,076, 3,454,625, 3,552,972, and 3,655,387, Japanese Patent Publication 9610/76, Japanese Patent Application (OPI) Nos. 29715/78 and 89626/79, Japanese Patent Application Nos. 85764/82 and 90909/82, and Hiroshi Horiguchi, *Shin Kaimenkasseizai* (Kyoritsu Shuppan, 1975), etc., in addition to the above described examples.

Of palladium complex salts used in the present invention, it is preferred that the complex salts of divalent palladium are those represented by formulae (II-1) and (II-2), and that the complex salts of tetravalent palladium are those represented by formulae (II-3) and (II-4).

(II-1)

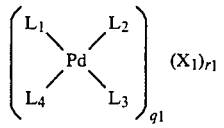

(II-2)

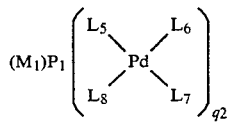

(II-3)

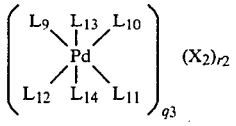

(II-4)

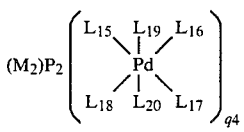

In the foregoing formulae, $M_1$ and $M_2$ each represents a cation selected from hydrogen ion, alkali metal ion, alkaline earth metal ion, and ammonium ion. $X_1$ and $X_2$ each represents an anion selected from halogen ion, nitrate ion, sulfate ion, hydrogen sulfate ion, phosphate ion, hydrogen phosphate ion, dihydrogen phosphate ion, hydroxide ion, chlorate ion, and perchlorate ion. $L_1$ through $L_{20}$ each represents a ligand selected from water, hydroxide ion, halogen ion, ammonia, nitrate ion, thiocyan ion, cyan ion, sulfate ion, carbonate ion, and oxo ion.

$P_1$, $P_2$, $q_1$, $q_2$, $q_3$, $q_4$, $r_1$ and $r_2$ can each be a positive integer of 1, 2, 3, or 4. $P_1$, $P_2$, $r_1$ and $r_2$ may also be 0.

In the formulae (II-1), (II-2), (II-3) and (II-4), it is preferred that $M_1$ and $M_2$ represent each a hydrogen ion, an alkali metal ion or an ammonium ion, and preferably a hydrogen ion. It is preferred that $X_1$ and $X_2$ each represents a halogen ion, a nitrate ion, or a perchlorate ion. It is preferred that $L_1$ through $L_{20}$ each represents water, a hydroxide ion, a halogen ion, ammonia, or a thiocyan ion, and preferably represents halogen ion. $P_1$, $P_2$, $q_1$, $q_2$, $q_3$, $q_4$, $r_1$ and $r_2$ can each be a positive integer such that the charge of the complex salt is 0. In the above described formulae, if $M_1$, $M_2$, $X_1$, $X_2$, $L_1$ through $L_{20}$ are designated, the identity of the complex is fixed. Further, $P_1$, $P_2$, $r_1$, and $r_2$ may be 0.

As complex salts of divalent or tetravalent palladium in the present invention, it is possible to use those described, for example, in *Kagaku Daijiten,* Vol. 7, page 169, edited by Kagaku Daijiten Henshuiinkai (Kyoritsu Shuppan, 1964); *Nyumon Chelate Kagaku,* by Kagehira Ueno (Nankodo, 1969), and *The Organic Chemistry of Palladium,* by P. M. Maitlis (Academic Press, 1971).

Examples of complex salts of divalent or tetravalent palladium ar described in the following.

Examples of compound:

II-1 $Na_2(PdCl_4)$
II-2 $H_2(PdCl_4)$
II-3 $Ca(PdCl_4)$
II-4 $H_2(PdBr_4)$
II-5 $K_2(PdBr_4)$
II-6 $Ba(PdBr_4)$
II-7 $(Pd(NH_3)_4)Cl_2$
II-8 $(Pd(NH_3)_4)(ClO_4)_2$
II-9 $(Pd(NH_3)_4)(NO_3)_2$
II-10 $Pd(NH_3)_2Cl_2$
II-11 $Pd(NH_3)_2(OH)_2$
II-12 $Na_2(PdCl_6)$
II-13 $H_2(PdBr_6)$
II-14 $(NH_4)_2(PdCl_6)$
II-15 $(NH_4)_2(PdCl_4)$
II-16 $K_2(PdCl_6)$
II-17 $K_2(PdBr_6)$
II-18 $Pd(NH_3)_2Br_2$
II-19 $Pd(NH_3)_2I_2$
II-20 $Pd(NH_3)_2SO_4$
II-21 $Pd(NH_3)_2CO_3$
II-22 $Pd(NH_3)_2(NO_3)_2$
II-23 $K_2(Pd(CNS)_4)$
II-24 $K_2(Pd(NO_3)_4)$
II-25 $(NH_4)_2(Pd(NO_3)_4)$
II-26 $(NH_4)_2(PdBr_2(NO_3)_4)$

The amount of the polyoxyethylene type surfactant used in the present invention may be varied according to the kind and shape of the photographic light-sensitive material to be added and coating process thereof, but it is generally preferred to be used in a range of from 5 to 500 mg, and preferably from 20 to 200 mg, per $m^2$ of the photographic light-sensitive material.

Further, the amount of the complex salt of divalent or tetravalent palladium used in the present invention varies according to the kind of light-sensitive silver halide emulsion in the photographic light-sensitive material, but it is generally used in an amount of from $10^{-9}$ to $10^{-2}$ mols, preferably from $5\times10^{-7}$ to $1\times10^{-3}$ mols, and more preferably from $1\times10^{-6}$ to $1\times10^{-4}$ mols, per mol of silver in silver halide emulsion layer.

In order to incorporate the polyoxyethylene type surfactant of the present invention in the layer of the photographic light-sensitive material, it is dissolved in water or an organic solvent such as methanol, ethanol or acetone or a mixed solvent composed of water and said organic solvent. Thereafter, the solution is incorporated in a light-sensitive emulsion layer or another light-insensitive layer (for example, a backing layer, an anti-halation layer, an intermediate layer or a protective layer, etc.) on a base, or it is sprayed on or applied to a surface of the base, or the base is immersed in the solution followed by drying.

The complex salt of divalent or tetravalent palladium of the present invention is preferred to be added to a light-sensitive emulsion layer in the photographic light-sensitive material, but it may be added to another light-insensitive layer. In order to add the palladium complex salt to the above described layer, the palladium complex salt may be added directly or as a solution obtained by dissolving it in water or the above described organic solvent or a mixed solvent composed of water and the above described organic solvent, or as an acid solution of palladium salt (for example, halide, etc.), to a coating solution for forming the layer. Then, the coating solution is applied and dried.

Further, in case of adding it to the emulsion layer, it may be added to the emulsion during production of the emulsion (e.g., chemical ripening step, etc.) or after conclusion thereof. It is particularly preferred to add it just before application after production of the emulsion.

The polyoxyethylene type surfactant of the present invention and the complex salt of divalent or tetravalent palladium of the present invention may be contained in the same layer or different layers in the photographic light-sensitive material. Further, they may be contained in a plurality of layers, respectively.

Silver halide grains in the photographic emulsions used in the photographic light-sensitive materials of the present invention may be in a regular crystal form such as cubic or octahedral, or in an irregular crystal form such as spherical or plate-like, or in a mixed crystal form thereof. They may comprise a mixture of grains having various different crystal forms.

These photographic emulsions can be prepared by processes as described, e.g., in P. Glafkides, *Chimie et Physique Photographique* (Paul Montel, 1967); G. F. Duffin, *Photographic Emulsion Chemistry* (The Focal Press, 1966); and V. L. Zelikman et al, *Making and Coating Photographic Emulsion* (The Focal Press, 1964). etc. That is, any of the known acid process, neutral process, and ammonia process may be used. As a manner of reacting soluble silver salts with soluble halide salts, any of single jet addition process, simultaneous mixing process, and combination thereof may be used.

During formation or physical ripening of silver halide grains, cadmium salts, zinc salts, lead salts, thallium salts, iridium salts or complex salts thereof, rhodium salts or complex salts thereof, or iron salts or complex salts thereof, etc., may be allowed to coexist therewith.

As binders for the photographic layers, it is possible to use proteins such as gelatin, casein, etc., cellulose compounds such as carboxymethyl cellulose, hydroxyethyl cellulose, etc., saccharose derivatives such as agar, sodium alginate, starch derivatives, etc., and synthetic hydrophilic colloids, for example, polyvinyl alcohol, poly-N-vinylpyrrolidone, acrylic acid copolymers, polyacrylamide or derivatives thereof, partially hydrolyzed products thereof, etc.

The term "gelatin" used in this specification means the so-called lime treated gelatin, acid treated gelatin, and enzyme treated gelatin.

In the photographic light-sensitive materials of the present invention, the photographic constituent layers may contain alkyl acrylate type latexes as described, e.g., in U.S. Pat. Nos. 3,411,911 and 3,411,912, and Japanese Patent Publication No. 5331/70.

Silver halide emulsions can be used without carrying out chemical sensitization, as so-called primitive emulsions, but they are generally chemically sensitized. In order to carry out chemical sensitization, processes described in the above described texts by Glafkides and Zelikman et al, and Die Grundlagen der Photographischen Prozesse mit Silberhalogeniden, edited by H. Frieser (Akademische Verlagsgesellschaft, 1968) can be used.

Namely, a sulfur sensitization process using sulfur containing compounds or active gelatin capable of reacting with silver ion, a reduction sensitization process using reductive substances, and a noble metal sensitization process using gold or other noble metal compounds can be used, alone or in combination. As sulfur sensitizing agents, thiosulfates, thioureas, thiazoles, rhodanines and other compounds can be used, examples of which have been described in U.S. Pat. Nos. 1,574,944, 2,410,689, 2,278,947, 2,728,668 and 3,656,955. As reduction sensitizing agents, stannous salts, amines, hydrazine derivatives, formamidinesulfinic acid, silane compounds, etc., can be used, examples of which have been described in U.S. Pat. Nos. 2,487,850, 2,419,974, 2,518,698, 2,983,609, 2,983,610 and 2,694,637. In order to carry out noble metal sensitization, not only gold complex salts but also complex salts of the group VIII metals such as platinum, iridium, palladium, etc. can be used, examples of which have been described in U.S. Pat. Nos. 2,399,083 and 2,448,060, British Pat. No. 618,061, etc.

The light-sensitive materials of the present invention can contain various compounds as stabilizers. Particularly, it is possible to add various compounds known as stabilizers, such as azoles, for example, benzothiazolium salts, nitroimidazoles, triazoles, benzotriazoles and benzimidazoles (particularly, nitro or halogen substituted derivatives); heterocyclic mercapto compounds, for example, mercaptothiazoles, mercaptobenzothiazoles, mercaptobenzimidazoles, mercaptothiadiazoles, mercaptotetrazoles (particularly, 1-phenyl-5-mercaptotetrazole) and mercaptopyridines; the above described heterocyclic mercapto compounds which have water-solubilizing groups such as carboxyl groups or sulfo groups, etc.; thioketo compounds, for example, oxazolinethione; azaindenes, for example, tetrazaindenes (particularly, 4-hydroxy-(1,3,3a,7)tetrazaindenes); benzenethiosulfonic acids; and benzenesulfinic acids; etc.

Further detailed examples, and methods of using them, are described, for example, in U.S. Pat. Nos. 3,954,474, 3,982,947 and 4,021,248, and Japanese Patent Publication No. 28660/77.

Examples of hardeners that may be used include aldehyde compounds such as mucochloric acid, mucobromic acid, mucophenoxychloric acid, mucophenoxybromic acid, formaldehyde, dimethylolurea, trimethylolmelamine, glyoxal, monomethyl glyoxal, 2,3-dihydroxy-1,4-dioxane, 2,3-dihydroxy-5-methyl-1,4-dioxane, succinaldehyde, 2,5-dimethoxytetrahydrofuran or glutaraldehyde; active vinyl compounds such as divinyl sulfone, methylenebismaleimide, 5-acetyl-1,3-diacryloyl-hexahydro-s-triazine, 1,3,5-triacryloyl-hexahydro-s-triazine, 1,3,5-trivinylsulfonyl-hexahydro-s-triazine-bis(vinylsulfonylmethyl)ether, 1,3-bis(vinylsulfonylmethyl)propanol-2, or bis($\alpha$-vinylsulfonylacetamide)ethane; active halogen compounds such as 2,4-dichloro-6-hydroxy-s-triazine sodium salt, 2,4-dichloro-6-methoxy-s-triazine, 2,4-dichloro-6-(4-sulfoanilino)-s-triazine sodium salt, 2,4-dichloro-6-(2-sulfoethylamino)-s-triazine or N,N'-bis(2-chloroethylcarbamoyl)piperazine; epoxy compounds such as bis(2,3-epoxypropyl)methylpropyl ammonium p-toluenesulfonate, 1,4-bis-(2',3'-epoxypropyloxy)butane, 1,3,5-triglycidyl-isocyanurate or 1,3-diglycidyl-5-($\gamma$-acetoxy-$\beta$-oxypropyl)isocyanurate; ethyleneimine compounds such as 2,4,6-triethyleneimino-s-triazine, 1,6-hexamethylene-N,N'-bis-ethyleneurea or bis-$\beta$-ethyleneiminoethyl thioether; methanesulfonic acid ester compounds, such as 1,2-di(methanesulfonoxy)ethane, 1,4-di(methanesulfonoxy)butane, or 1,5-di(methanesulfonoxy)pentane; carbodiimide compounds; isoxazole compounds; and inorganic compounds such as chromium alum.

The photographic emulsion layers or other constituent layers in the light-sensitive materials of the present invention may contain surfactants other than those of the present invention, for various purposes, such as, as coating aids, prevention of electrification, improvements of slipping properties, emulsification and dispersing, prevention of adhesion, and improvement of photographic characteristics (for example, acceleration of development, rendering high contrast, and sensitization), etc.

For example, it is possible to use nonionic surface active agents such as saponin (steroid type), alkylene oxide derivatives (for example, polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamine or amides, and polyethylene oxide adducts of silicone), glycidol derivatives (for example, alkenylsuccinic acid polyglyceride and alkylphenol polyglyceride), fatty acid esters of polyhydric alcohols, or alkyl esters of saccharose, etc.; anionic surface active agents having acid groups such as a carboxyl group, a sulfo group, a phospho group, a sulfuric acid ester group, a phosphoric acid ester group, etc., such as alkylcarboxylates, alkylsulfonates, alkylbenzenesulfonates, alkylnaphthalenesulfonates, alkylsulfates, alkylphosphates, N-acyl-N-alkyltaurine, sulfosuccinic acid esters, sulfoalkylpolyoxyethylene alkylphenyl ethers, or polyoxyethylene alkylphosphoric acid esters, etc., ampholytic surface active agents such as amino acids, aminoalkylsulfonic acids, aminoalkylsulfuric or phosphoric acid esters, alkylbetaines, amine oxides, etc., and cationic surface active agents such as alkylamine salts, aliphatic or aromatic quaternary ammonium salts, heterocyclic quaternary ammonium salts such as pyridinium or imidazolium salt, etc., or aliphatic or heterocyclic phosphonium or sulfonium salts, etc.

The photographic emulsions of the present invention may be spectrally sensitized with methine dyes and others. Examples of dyes used include cyanine dyes, merocyanine dyes, complex cyanine dyes, complex merocyanine dyes, holopolar cyanine dyes, hemicyanine dyes, styryl dyes and hemioxonol dyes. Particularly useful dyes include cyanine dyes, merocyanine dyes and complex merocyanine dyes. In these dyes, any of the nuclei conventionally used in cyanine dyes as basic heterocyclic nuclei can be used. For instance, it is possible to utilize a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus, etc.; nuclei wherein an alicyclic hydrocarbon ring is fused with the above described nuclei; and nuclei wherein an aromatic hydrocarbon ring is fused with the above described nuclei, for example, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus, etc. These nuclei may have substituents on carbon atoms in the nucleus.

In merocyanine dyes or complex mercocyanine dyes, 5- or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus, a thiobarbituric acid nucleus, etc., may be used as the ketomethylene structure-containing nuclei.

The photographic emulsions of the present invention may contain dye-image-forming couplers, namely, compounds which form a dye by reacting with an oxidation product of aromatic amine (generally a primary amine) developing agents. The couplers are preferred to have a hydrophobic group called a ballast group in the molecule, so as to be nondiffusible. The couplers may be any of 4-equivalent couplers and 2-equivalent couplers, with respect to silver ion. Further, the couplers may be colored couplers having an effect of color correction or may be couplers which release a development inhibitor by development (the so-called DIR coupler). The couplers may be those which form a colorless product by a coupling reaction.

As yellow couplers, known open chain ketomethylene type couplers can be used. E.g., benzoylacetanilide type and pivaloylacetanilide type compounds are advantageously used.

As magenta couplers, pyrazolone compounds, imidazolone type compounds, cyanoacetyl compounds, etc., can be used. Pyrazolone type compounds are particularly advantageous.

As cyan couplers, phenol type compounds, and naphthol type compounds, etc., can be used.

In the photographic light-sensitive materials of the present invention, the silver halide emulsion layers may be provided on not only one side, but also on both sides, of the base.

The protective layer of the silver halide photographic light-sensitive materials of the present invention is a layer composed of hydrophilic colloid. As the hydrophilic colloid used, there are those described above. The protective layer may have a monolayer structure or a multilayer structure.

In emulsion layers or, preferably, the protective layer of the silver halide photographic light-sensitive materials of the present invention, matting agents and/or smoothing agents, etc. may be incorporated. As examples of matting agents, there are organic compounds such as water dispersive vinyl polymers such as polymethyl methacrylate, etc. and inorganic compounds such as silver halide, strontium barium sulfate, etc., which have a suitable particle size (those having a diameter of 0.3 to 5$\mu$ or those having a diameter of 2 times or more, and particularly 4 times or more, the thickness of the protective layer are preferred). The smoothing agents not only serve for preventing adhesion troubles similarly to the matting agents, but also they are effective for improving friction chracteristics relating to camera adaptability of, particularly, movie films in case of photographing or projecting. For example, waxes such as liquid paraffin or higher aliphatic acid esters, polyfluorohydrocarbons or derivatives thereof, and silicones such as polyalkylpolysiloxane, polyarylpolysiloxane, polyalkylarylpolysiloxane or alkylene oxide addition derivatives thereof, etc. are suitably used.

In the silver halide photographic light-sensitive materials of the present invention, an antihalation layer, an intermediate layer, a filter layer, etc., can also be provided as occasion demands.

As silver halide photographic light-sensitive materials using silver halide photographic emulsions of the present invention, there are X-ray sensitive materials, lithographic light-sensitive materials, black-white photographic light-sensitive materials, color negative light-sensitive materials, color reversal light-sensitive materials, color printing papers, etc.

In the photographic light-sensitive materials of the present invention, other various additives can also be used as occasion demands. For example, dyes, development accelerators, fluorescent whitening agents, color stain preventing agents, ultraviolet ray absorbing agents, and the like may be used, depending upon the particular characteristics desired. More specifically, such as are described in *Research Disclosure,* Volume 176, pages 28–30 (RD-17643, 1978) can be used.

The photographic emulsions of the present invention are applied to flexible bases conventionally used, such as plastic films, paper, cloth, etc., or rigid bases such as glass, porcelain, metal, etc., by a dip coating process, a roll coating process, a curtain coating process, an extrusion coating process, etc. Useful flexible bases are films composed of semisynthetic or synthetic high polymers such as cellulose nitrate, cellulose acetate, cellulose acetate butyrate, polystyrene, polyvinyl chloride, polyethylene terephthalate or polycarbonate, etc., and coated or laminated papers to which a baryta layer, α-olefin polymer (for example, polyethylene, polypropylene or ethylene/butene copolymer), etc., is applied.

In the following, the present invention is illustrated with reference to examples, but the present invention is not limited thereto.

EXAMPLE 1

(1) Preparation of sample

To a polyethylene terephthalate film base having a thickness of 180 μm which was subjected to undercoating, a silver halide emulsion layer having the following composition was applied, and a protective layer having the following composition was applied to the emulsion layer and dried to prepare a black-white silver halide light-sensitive material. A polyoxyethylene type surfactant of the present invention was added to the protective layer and a palladium complex salt was added to the emulsion layer.

| | |
|---|---|
| (Emulsion layer) | |
| Thickness: | about 5 μm |
| Composition and amount: | |
| Gelatin | 2.5 g/m$^2$ |
| Silver iodobromide (silver iodide: 2.0% by mol) | 5 g/m$^2$ |
| Palladium complex salt (II-2) or comparative compound | Refer to Table 1 |
| (Protective layer) | |
| Thickness: | about 1 μm |
| Composition and amount: | |
| Gelatin | 1.7 g/m$^2$ |
| 2,6-Dichloro-6-hydroxy-1,3,5-triazine sodium salt | 10 mg/m$^2$ |
| Sodium N—oleyl-N—methyltaurine | 7 mg/m$^2$ |
| Polyoxyethylene type surfactant of the present invention (refer to Table 1) | 40 mg/m$^2$ |

(2) Method of evaluating antistatic property

The antistatic property was determined by measurement of surface resistivity and generation of static mark.

1. The surface resistivity was obtained by putting a test strip of the sample between brass electrodes having a length of 10 cm placed at an interval of 0.14 cm (the part which touches with the test strip was composed of stainless steel) and measuring a 1 minute value by means of an insulation tester: type TR8651 made by Takeda Riken Co.

2. The static mark generation test was carried out by a method which comprises putting a nonexposed light-sensitive material on a rubber sheet so that the antistatic agent containing side faced to the rubber sheet, pressing the light-sensitive material aginst the rubber sheet by a rubber roll, and separating it to cause generation of static mark.

Conditions for measurement are as follows. Namely, the surface resistivity was measured at 25° C. and 25% RH, and the static mark generation test was carried out at 25° C. and 25% RH. The test strip of the sample was previously conditioned under the above described condition for about 24 hours.

In order to evaluate degree of generation of static marks, each sample was developed at 20° C. for 5 minutes with a developing solution having the following composition.

| Composition of developing solution: | |
|---|---|
| N—methyl-p-aminophenol sulfate | 4 g |
| Anhydrous sodium sulfite | 60 g |
| Hydroquinone | 10 g |
| Sodium carbonate (1 hydrate) | 53 g |
| Potassium bromide | 25 g |
| Water to make | 1 liter |

Evaluation of static marks was carried out according to the following 5-level standard.

A: Generation of static marks is not observed.
B: Static marks slightly generated.
C: Static marks moderately generated.
D: Static marks extensively generated.
E: Static marks generated on the whole face.

(3) Method of evaluating antifogging property

After the sample prepared in (1) was allowed to stand at 50° C. and 60% RH for 10 days, it was developed at 35° C. for 25 seconds with a developing solution for X-ray films: RD III (produced by Fuji Photo Film Co.) by means of a roll transfer type automatic developing apparatus: Fuji RN (produced by Fuji Photo Film Co.). It was then fixed, washed with water and dried, and the optical density (Dmin) of the nonexposed part was measured.

On the other hand, after the sample was allowed to stand at 25° C. and 60% RH for 10 days, it was subjected to the same development processing as described above, and optical density ($Dm_0$) of the nonexposed part was measured.

The value (Δfog) of fog increase due to storage before use at a high temperature was indicated by $Dm-Dm_0$.

Results obtained are shown in Table 1.

The amount of the comparative compound used was the maximum amount at which sensitivity was not reduced.

TABLE 1

| Sample No. | Polyoxyethylene Type Surfactant (mg/m$^2$) | | Antifogging Agent (mol/mol-Ag) | |
|---|---|---|---|---|
| 1 | — | | — | |
| 2 | — | | II-2 | $1 \times 10^{-5}$ |
| 3 | I-31 | 60 | — | |
| 4 | " | " | II-2 | $5 \times 10^{-6}$ |
| 5 | " | " | " | $1 \times 10^{-5}$ |
| 6 | " | " | " | $1.5 \times 10^{-5}$ |
| 7 | I-6 | 30 | — | |
| 8 | " | " | II-2 | $1 \times 10^{-5}$ |
| 9 | I-3 | 40 | — | |
| 10 | " | " | II-7 | $1.5 \times 10^{-5}$ |
| 11 | I-13 | " | — | |
| 12 | " | " | II-13 | $1.5 \times 10^{-5}$ |
| 13 | I-28 | " | — | |
| 14 | " | " | II-23 | $1.5 \times 10^{-5}$ |
| 15 | I-47 | " | — | |
| 16 | " | " | II-26 | $1.5 \times 10^{-5}$ |
| 17 | I-53 | 40 | — | |
| 18 | " | " | II-2 | $1.5 \times 10^{-5}$ |
| 19 | I-31 | 60 | Comparative compound a | $5 \times 10^{-5}$ |

TABLE 1-continued

| | | | | |
|---|---|---|---|---|
| 20 | " | " | Comparative compound b | " |
| 21 | " | " | Comparative compound c | " |

| Sample No. | Value of Fog Increase (Δfog) | Antistatic Property Surface Sensitivity (Ω) | Static Mark |
|---|---|---|---|
| 1 | 0.08 | $6.5 \times 10^{14}$ | E |
| 2 | 0.03 | $6.9 \times 10^{14}$ | E |
| 3 | 0.30 | $3.5 \times 10^{11}$ | A |
| 4 | 0.09 | $3.9 \times 10^{11}$ | A |
| 5 | 0.05 | $3.3 \times 10^{11}$ | A |
| 6 | 0.02 | $3.2 \times 10^{11}$ | A |
| 7 | 0.16 | $4.8 \times 10^{11}$ | A |
| 8 | 0.04 | $4.3 \times 10^{11}$ | A |
| 9 | 0.18 | $5.2 \times 10^{11}$ | A |
| 10 | 0.04 | $4.7 \times 10^{11}$ | A |
| 11 | 0.15 | $6.1 \times 10^{11}$ | A |
| 12 | 0.04 | $7.2 \times 10^{11}$ | A |
| 13 | 0.21 | $4.4 \times 10^{11}$ | A |
| 14 | 0.03 | $4.2 \times 10^{11}$ | A |
| 15 | 0.25 | $3.3 \times 10^{11}$ | A |
| 16 | 0.03 | $3.6 \times 10^{11}$ | A |
| 17 | 0.26 | $3.5 \times 10^{11}$ | A |
| 18 | 0.04 | $4.0 \times 10^{11}$ | A |
| 19 | 0.22 | $4.1 \times 10^{11}$ | A |
| 20 | 0.19 | $3.5 \times 10^{11}$ | A |
| 21 | 0.25 | $3.8 \times 10^{11}$ | A |

Comparative compound a

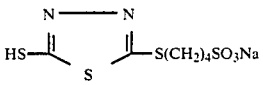

Comparative compound b

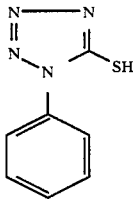

Comparative compound c

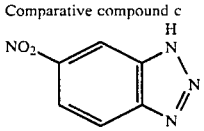

It is understood from Table 1 that photographic light-sensitive materials: sample Nos. 3–21 in which the polyoxyethylene type surfactant is used for preventing electrification have an excellent antistatic property, but sample Nos. 3, 7, 9, 11, 13, 15, and 17, in which the polyoxyethylene type surfactant was used, but no antifogging agent was added, show a significant increase in fog when stored at a high temperature as compared with sample Nos. 1 and 2, in which the polyoxyethylene type surfactant was not added.

Further, it is obvious that, in case of using the polyoxyethylene type surfactants, the increase in fog when stored at a high temperature which is caused by using the polyoxyethylene type surfactants can not be sufficiently prevented, by addition of the organic heterocyclic compounds which are well-known as antifogging agents in the photographic field (see Sample Nos. 19, 20 and 21).

On the contrary, in sample Nos. 4, 5, 6, 8, 10, 12, 14, 16 and 18 of the present invention in which the polyoxyethylene type surfactant is used and the palladium complex is added as an antifogging agent, an excellent antistatic property was shown, and the increase in fog when stored at a high temperature can be remarkably prevented.

It is obvious from the above description that photographic light-sensitive materials in which the antistatic property and the antifogging property are simultaneously satisfied even when stored at a high temperature can be obtained by incorporating the polyoxyethylene type surfactant and the palladium complex in a light-sensitive silver halide emulsion or another hydrophilic colloid layer of the photographic light-sensitive materials.

While the invention has been described in detail and with reference to specific embodiments thereof, it will be apparent to one skilled in the art that various changes and modifications can be made therein without departing from the spirit and scope thereof.

What is claimed is:

1. In a silver halide photographic light-sensitive element having at least one light-sensitive silver halide emulsion layer on a base, the improvement wherein said light-sensitive silver halide emulsion layer or another hydrophilic colloid layer on said base contains a polyoxyethylene type surfactant and a complex salt of divalent or tetravalent palladium, and wherein said polyoxyethylene type surfactant is represented by a member selected from formula (I-3)

Formula (1-3)

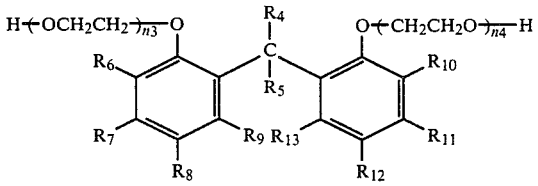

wherein $R_7$, $R_9$, $R_{11}$ and $R_{13}$ each represents a hydrogen atom, a substituted or unsubstituted alkyl group, an aryl group, an alkoxy group, a halogen atom, an acyl group, an amide group, a sulfonamide group, a carbamoyl group, or a sulfamoyl group; $R_6$, $R_8$, $R_{10}$, and $R_{12}$ each represents a unsubstituted alkyl group, an aryl group, an alkoxy group, a halogen atom, an acyl group, an amide group, a sulfonamide group, a carbmoyl group, or a sulfamoyl group; $R_4$ and $R_5$ each represents a hydrogen atom, a substituted or unsubstituted alkyl group, an aryl group, or heteroaromatic ring; or $R_4$ and $R_5$, $R_6$ and $R_7$, $R_8$ and $R_9$, $R_{10}$ and $R_{11}$, and $R_{12}$ and $R_{13}$ may form a substituted or unsubstituted ring by linking together; and $n_3$ and $n_4$ are each an average degree of polymerization of ethylene oxide within the range of from 2 to 50.

2. A silver halide photographic light-sensitive element as in claim 1, wherein said complex salt of divalent or tetravalent palladium is a member selected from the formulae (II-1), (II-2), (II-3) and (II-4)

Formula (II-1)

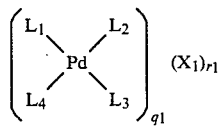

Formula (II-2)

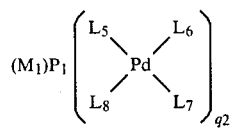

-continued

Formula (II-3)

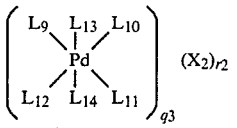

Formula (II-4)

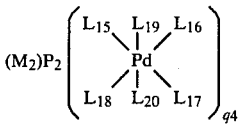

wherein $M_1$ and $M_2$ each represents a cation selected from hydrogen ion, alkali metal ion, alkaline earth metal ion, and ammonium ion; $X_1$ and $X_2$ each represents an anion selected from halogen ion, nitrate ion, sulfate ion, hydrogen sulfate ion, phosphate ion, hydrogen phosphate ion, dihydrogen phosphate ion, hydroxide ion, chlorate ion, and perchlorate ion; $L_1$ through $L_{20}$ each represents a ligand selected from water, hydroxide ion, halogen ion, ammonia, nitrate ion, thiocyan ion, cyan ion, sulfate ion, carbonate ion, and oxo ion; $P_1$, $P_2$, $q_1$, $q_2$, $q_3$, $q_4$, $r_1$ and $r_2$ can each represent a positive integer of 1, 2, 3, or 4, and $P_1$, $P_2$, $r_1$ and $r_2$ can also be 0.

3. A silver halide photographic light-sensitive element as in claim 2, wherein the palladium complex salt is a complex salt of divalent palladium represented by a member selected from formulae (II-1) and (II-2).

4. A silver halide photographic light-sensitive element as in claim 3, wherein $L_1$, $L_2$, $L_3$, $L_4$, $L_5$, $L_6$, $L_7$, and $L_8$ each represents a halogen ion.

5. A silver halide photographic light-sensitive element as in claim 4, wherein $L_1$, $L_2$, $L_3$, $L_4$, $L_5$, $L_6$, $L_7$, and $L_8$ each represents a chlorine ion.

6. A silver halide photographic light-sensitive element as in claim 1, wherein the polyoxyethylene type surfactant is used in a range of from 20 to 200 mg per $m^2$ of the element and the complex of divalent or tetravalent palladium is used in an amount of from $5\times10^{-7}$ to $1\times10^{-3}$ mols per mol of silver and the silver halide emulsion layer.

7. A silver halide photographic light-sensitive element as in claim 3, wherein the polyoxyethylene type surfactant is used in a range of from 20 to 200 mg per $m^2$ of the element and the complex of divalent palladium is used in an amount of from $5\times10^{-7}$ to $1\times10^{-3}$ mols per mol of silver and the silver halide emulsion layer.

8. A silver halide photographic light-sensitive element as in claim 2, wherein the polyoxyethylene type surfactant is used in a range of from 20 to 200 mg per $m^2$ of the element and the complex of divalent or tetravalent palladium is used in an amount of from $5\times10^{-7}$ to $1\times10^{-3}$ mols per mol of silver and the silver halide emulsion layer.

9. A method of preventing electrification of a silver halide photographic light-sensitive element having at least one light-sensitive silver halide emulsion layer on a base, comprising incorporating a polyoxyethylene type surfactant and a complex salt of divalent or tetravalent palladium in at least one layer of said material, wherein said polyoxyethylene type surfactant is represented by a member selected from formula (I-3)

Formula (I-3)

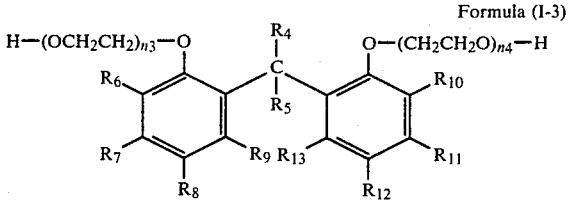

wherein $R_7$, $R_9$, $R_{11}$, and $R_{13}$ each represents a hydrogen atom, a substituted or unsubstituted alkyl group, an aryl group, an alkoxy group, a halogen atom, an acyl group, an amide group, a sulfonamide group, a carbamoyl group, or a sulfamoyl group; $R_6$, $R_8$, $R_{10}$, and $R_{12}$ each represents a unsubstituted alkyl group, an aryl group, an alkoxy group, a halogen atom, an acyl group, an amide group, a sulfonamide group, a carbamoyl group, or a sulfamoyl group; $R_4$ and $R_5$ each represents a hydrogen atom, a substituted or unsubstituted alkyl group, an aryl group, or heteroaromatic ring; or $R_4$ and $R_5$, $R_6$ and $R_7$, $R_8$ and $R_9$, $R_{10}$ and $R_{11}$ may form a substituted or unsubstituted ring by linking together; and $n_3$ and $n_4$ are each an average degree of polymerization of ethylene oxide within the range of from 2 to 50.

10. A method of preventing electrification of a silver halide photographic light-sensitive element as in claim 9, wherein said complex salt of divalent or tetravalent palladium is a member selected from the formulae (II-1), (II-2), (II-3), and (II-4)

Formula (II-1)

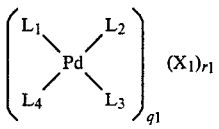

Formula (II-2)

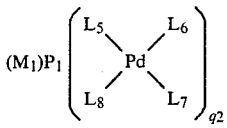

Formula (II-3)

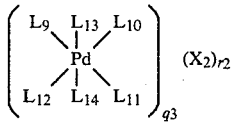

Formula (II-4)

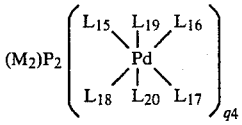

wherein $M_1$ and $M_2$ each represents a cation selected from hydrogen ion, alkali metal ion, alkaline earth metal ion, and ammonium ion; $X_1$ and $X_2$ each represents an anion selected from halogen ion, nitrate ion, sulfate ion, hydrogen sulfate ion, phosphate ion, hydrogen phosphate ion, dihydrogen phosphate ion, hydroxide ion, chlorate ion, and perchlorate ion; $L_1$ through $L_{20}$ each represents a ligand selected from water, hydroxide ion, halogen ion, ammonia, nitrate ion, thiocyan ion, cyan ion, sulfate ion, carbonate ion, and oxo ion; $P_1$, $P_2$, $q_1$, $q_2$, $q_3$, $q_4$, $r_1$ and $r_2$ can each represent a positive integer of 1, 2, 3, or 4, and $P_1$, $P_2$, $r_1$ and $r_2$ can also be 0.

11. A method of preventing electrification of a silver halide photographic light-sensitive element as in claim 9, wherein the polyoxyethylene type surfactant is used in a range of from 20 to 200 mg per $m^2$ of the element and the complex of divalent or tetravalent palladium is used in an amount of from $5\times10^{-7}$ to $1\times10^{-3}$ mols per mol of silver and the silver halide emulsion layer.

12. A method of preventing electrification of a silver halide photographic light-sensitive element as in claim 10, wherein the palladium complex salt is a complex salt of divalent palladium represented by a member selected from formulae (II-1) and (II-2).

13. A method of preventing electrification of a silver halide photographic light-sensitive element as in claim 12, wherein the polyoxyethylene type surfactant is used in a range from 20 to 200 mg per $m^2$ of the material and the complex of divalent palladium is used in an amount of from $5\times10^{-7}$ to $1\times10^{-3}$ mols per mol of silver and the silver halide emulsion layer.

* * * * *